US005749558A

United States Patent [19]

Wallo

[11] Patent Number: 5,749,558

[45] Date of Patent: May 12, 1998

[54] WALL-MOUNTED PICTURE HANGER

[76] Inventor: William H. Wallo, 8 Leeward Island, Clearwater, Fla. 34630

[21] Appl. No.: 797,825

[22] Filed: Feb. 10, 1997

[51] Int. Cl.[6] ..... A47G 1/00

[52] U.S. Cl. ..... 248/475.1; 248/476; 248/489

[58] Field of Search ..... 248/475.1, 476, 248/477, 489, 494, 300; 40/759

[56] References Cited

U.S. PATENT DOCUMENTS

| | | | |
|---|---|---|---|
| 3,294,356 | 12/1966 | Sherman | 248/476 |
| 3,955,790 | 5/1976 | Ballin | 248/489 |
| 4,458,873 | 7/1984 | Sutherland | 40/759 |
| 4,804,161 | 2/1989 | Wallo | 248/544 |
| 5,328,139 | 7/1994 | Barnes | 248/475.1 |

*Primary Examiner*—Victor N. Sakran
*Attorney, Agent, or Firm*—David Kiewit

[57] ABSTRACT

A nail-on picture hanger supports a picture frame generally flush against a vertical supporting surface and in a level orientation. The preferred hanger comprises a T-shaped plate having a vertically oriented leg extending downwardly from a horizontal top portion that includes three nailing guides. A pair of cantilevered arms extending laterally outward from the plate are selectively settable so as to ensure a level horizontal orientation for the picture. The preferred hanger can be quickly and permanently mounted to a wall by using only a hammer and a three nails.

6 Claims, 2 Drawing Sheets

WALL-MOUNTED PICTURE HANGER

STATEMENT REGARDING FEDERALLY SPONSORED RESEARCH OR DEVELOPMENT

Not applicable

CROSS REFERENCE TO RELATED APPLICATIONS

Not applicable

BACKGROUND OF THE INVENTION

1. Field of the Invention

The invention relates to methods and apparatus for hanging picture frames and like objects on walls in a manner so as to ensure that the suspended object remains in a permanently level position 2. Description of Prior Art According to many interior decorators, a crookedly hung picture can spoil the decor of an entire room. Nonetheless, the most common prior art picture hangers make no provision for leveling or precisely setting the height of a picture.

Hanging picture frames or like objects from walls or other vertical supports has generally involved securing individual hooks, nails or hangers to the wall. A horizontal picture wire strung across the back of the suspended object is usually used for engaging the nail or hook. Alternately, a centered nail-on hanger bar may be attached to the back of a picture frame for engagement with the hook or nail. When such objects are hung on a nail or hook, they frequently tend to skew—i.e., a nominally horizontal top surface of the object tilts from a true horizontal line. Re-leveling skewed pictures can become a continuous annoying occurrence. Another problem with nail-supported pictures is that it is extremely difficult to equally space and controllably set the height of ones of a grouping of pictures. Yet another problem with nail-supported objects is that the picture or other suspended object tends to cant outwardly at an angle to the wall so that its top is more distal from the wall than its bottom.

Many inventors have sought to solve these problems in the art of picture hanging. Notable among the prior patent art teaching in this area is U.S. Pat. No. 4,804,161, wherein the inventor of the present invention teaches apparatus and method for hanging a picture framed with an extruded aluminum frame having a top moulding with a downwardly facing surface. The disclosure of U.S. Pat. No. 4,804,161 is herein incorporated by reference.

SUMMARY OF THE INVENTION

The invention provides a nail-on adjustable hanger device for supporting a picture frame generally flush against a vertical supporting surface and in a level orientation. The preferred hanger comprises a T-shaped plate having a vertically oriented leg extending downwardly from a nail-on horizontal top portion. The vertical leg of the T provides a lever action to prevent the upper portion of the plate from tilting away from the wall which would allow the picture to hang in a cocked orientation. The preferred hanger provides a pair of cantilevered arms on which a picture frame may be hung, the arms selectively settable so as to ensure a level horizontal orientation for the picture. The preferred hanger can be quickly and permanently mounted to a wall by using only a hammer and three nails.

It is an object of the invention to provide method and apparatus for hanging a framed picture or a like object from a wall or other vertical supporting surface in a permanently level attitude in which the top of the frame is horizontal.

It is a further object of the invention to provide means for hanging a framed picture or a like object from a wall or other vertical supporting surface, the means ensuring that the frame will return to a level attitude when moved or jarred.

It is an additional object of the invention to provide a picture hanger device that is compatible with a wide variety of popular picture frames, including extruded aluminum frames, roll-formed sheet metal frames, and wooden frames of various shapes and configurations.

It is yet an additional object of the invention to provide a picture hanger comprising two upwardly extending support portions, each having a horizontally disposed ledge portion respectively associated therewith. A preferred embodiment of the invention satisfies this objective by supporting ones of a wide variety of different picture frames on either the upwardly extending support portions or on the horizontal ledges.

It is yet a further object of the invention to provide a wall bracket that can be mounted permanently and securely to a wall using conventional tools such as a hammer and three nails.

It is also an object of the invention to provide a wall hanger for framed pictures and the like that supports the frame on sharp suspension points that will prevent the frame from shifting horizontally.

It is additionally an object of the invention to provide a wall hanger having two cantilevered arms with upstanding end segments at the free ends thereof, the cantilevered arms capable of being plastically deformed so that a user can bend one of the arms in order to place the two end segments on the same horizontal line, as is desired when hanging a picture frame in a level orientation. Specifically, it is an object of the invention to provide a self-leveling wall hanger that allows a user to first hang a frame on the hanger and to then bend one of the cantilevered arms by exerting a downward force on one side of a picture frame in order to level the frame.

Moreover, it is an overall object of the invention to provide the benefits described supra in a wall hanger that can be made from a single piece of material by the use of economical stamping processes known in the metal working arts. Specifically, it is an object of the invention to provide these benefits with a device made in a single operation using a progressive die mounted in a high-speed stamping press.

DETAILED DESCRIPTION OF THE PREFERRED EMBODIMENT

Figure 9:
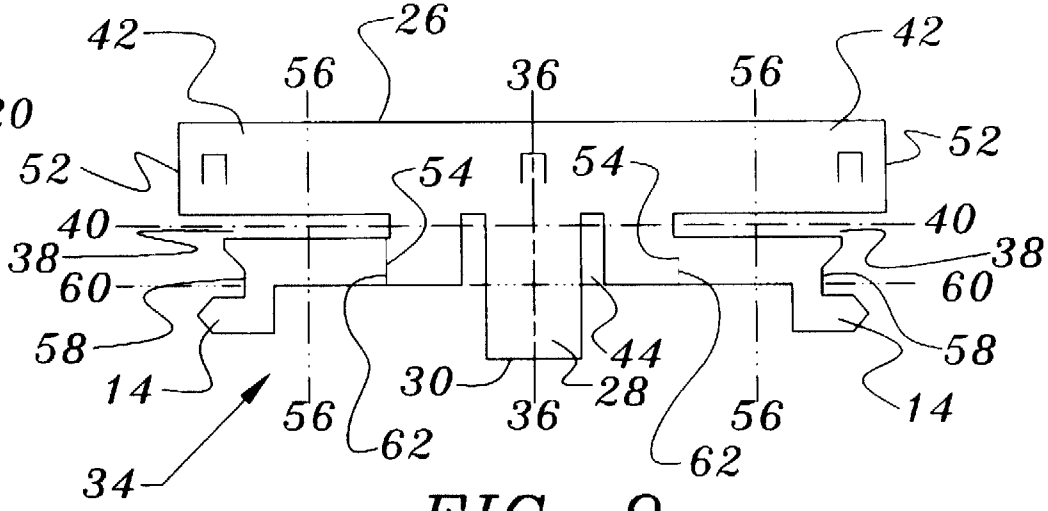
FIG. 9 is a front elevational view of a sheet of material that can be bent to yield a preferred embodiment of the invention.

A preferred hanger of the invention 10 supports a picture frame 12 or the like on two spaced apart and vertically pointed end segments 14 of cantilevered arms 16 that extend laterally outward from a back plate portion 18. The hanger 10 may be fastened to a wall 20 or other vertical supporting surface by driving one or more nails 22 through angled nail guides 24 that preferably provide a 45° angle between the nail 22 and the wall 20. In a preferred embodiment, three such nail guides 24 are provided adjacent a top edge 26 of the back plate 18. In order to strengthen the hanger 10 and prevent its top 26 from being cocked or pulled away from the wall 20, a preferred hanger 10 comprises a depending leg portion 28. As is the case with other picture hanging hooks, the bottom 30 of the depending leg 28 bears on the wall 20 at a some distance from the nail 22 and provides leverage counteracting the tendency of a heavy picture frame 12 to partially pull out the nail 22 and thereby cock the picture or mirror 32 away from the wall.

The preferred hanger 10 may be made by die-cutting a blank 34 out of a sheet of material—e.g., from a coil of sheet steel and forming the blank 34 into a hanger 10 by using a progressive die mounted in a high speed punch press. The die-cut portion 34 preferably has a shape selected to have mirror symmetry about a mirror plane 36 (depicted with a long dash, short dash line in FIG. 9) perpendicular to the plane of the blank 34. The die-cut sheet portion 34 comprises a pair of symmetrically disposed bifurcating slits 38 lying along a first fold line 40 (depicted in dot-dash phantom in FIG. 9) perpendicular to the mirror plane 36. The laterally extending bifurcating slits 38 define portions of the hanger 10 that are referred to as upper arms 42 and cantilevered arms 16 for reasons that will be clear from the ensuing disclosure. The preferred hanger 10 also comprises a second symmetrical pair of bifurcating slits 44 that are parallel to the mirror plane 36 and that extend across the first fold line 40 from the bottom of the sheet portion.

Nailing guides 24 arc preferably shear formed in the upper arms 42 by cutting a U- or V-shaped slit 46 through the sheet of material to define a guide tongue 48 having its free end adjacent the top edge 26 of the upper arm 42. The tongue 48 is bent away from the back surface 50 of the plate 18. In a preferred embodiment three such nail guides 24 are formed, with one of them located at the mirror plane 36 and the other two symmetrically disposed adjacent the free ends 52 of the upper arms 42. The tongues 48 are preferably bent away from the back plate 18 at an angle of about 45° in order to guide the nail 22 at an optimal angle.

Figure 1:
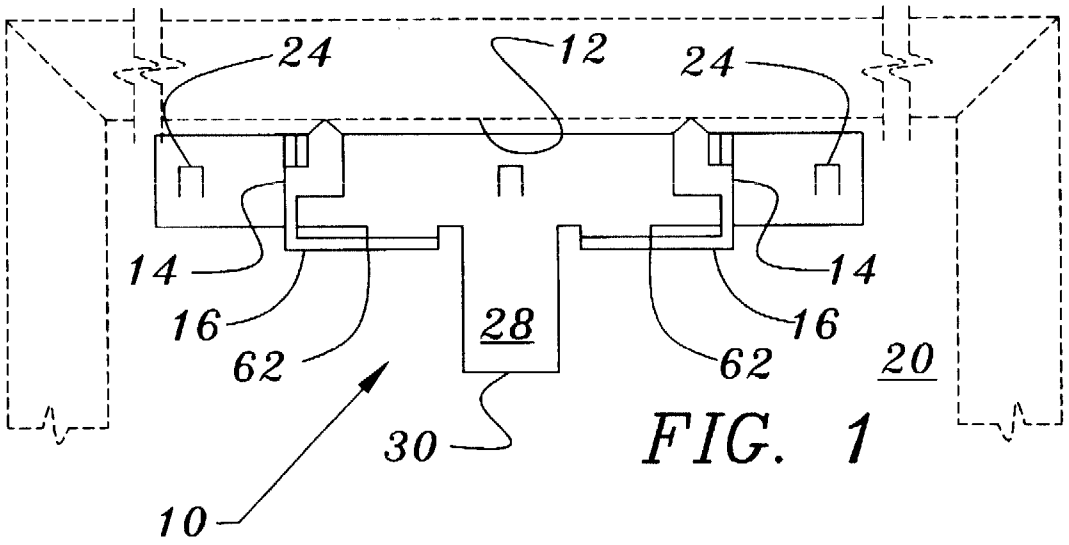
FIG. 1 is a front elevational view of a preferred hanging device of the invention supporting a top molding of a wooden picture frame on two vertically pointed cantilevered arms.
Figure 7:
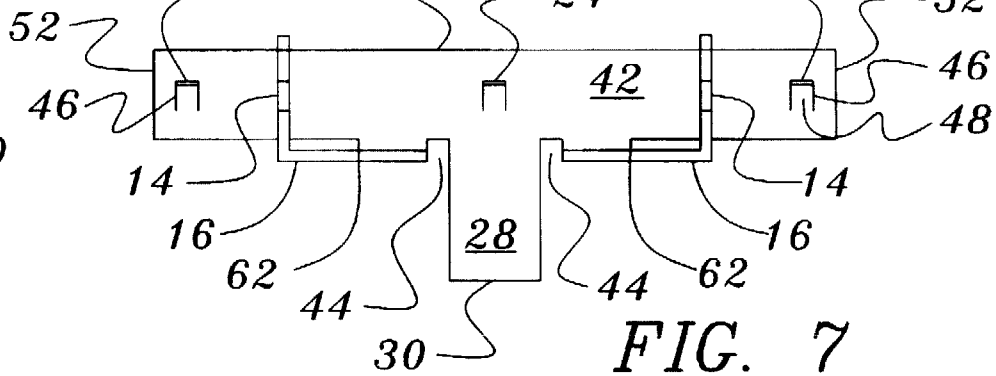
FIG. 7 is a front elevational view of a partially fabricated hanger of FIG. 1, the hanger having had two of three bends made in it.
Figure 8:
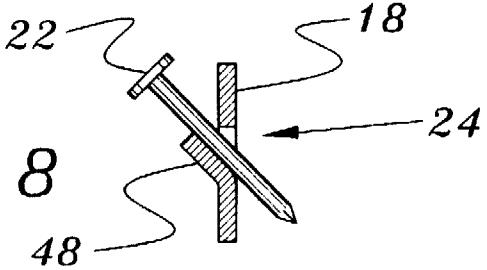
FIG. 8 is a cross-sectional view, taken as indicated by the arrow-headed dotted line 8—8 in FIGS. 6 and 7, and showing the back plate and shear-formed guide slot opening for a nail, which is preferably hammered into a wall or other vertical surface at a forty five degree angle.
Figure 4:
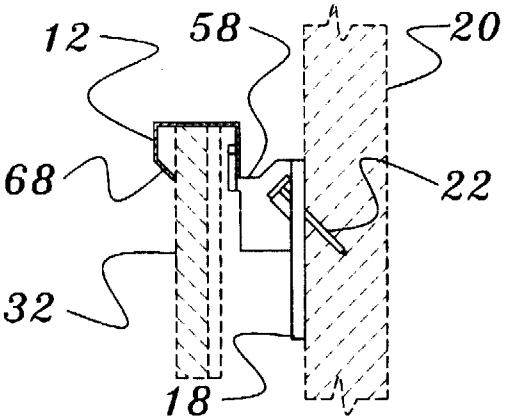
FIG. 4 is a right side elevational view of the device of FIG. 1 showing the nail-on hanger attached to a wall and supporting a sheet-metal picture frame on ledge portions of the hanger.

In the preferred embodiment the junction portions 54 of the blank 34, where the cantilevered arms 16 join the upper arms 42, are bent about the first fold line 40 through an angle of substantially 90° so that the plane of the flat cantilevered arms 16 is perpendicular to the backing plate 18 (It should also be clear that although the first fold line 40 is depicted as extending across the depending leg 28, that leg is not folded). A second bend, also of substantially 90°, is made in each of the cantilevered arm about respective second fold lines 56 (depicted in double-dotted phantom in FIG. 9) so as to define upstanding intermediate 58 and end segments 14 of the cantilevered arms 16. A third bend, also of substantially 90°, is made in each of the cantilevered arms about respective third fold lines 60 (depicted in triple-dotted phantom in FIG. 4) to complete the fabrication of the hanger 10 as depicted in FIG. 1. FIG. 7 depicts the incompletely formed structure having the first two bends, but not the third.

It will be understood to those skilled in the art that although the fabrication process recited hereinbefore employs a series of steps to make the hanger 10, other sequences of bending operations can yield the same structure. Moreover, a single operation can carry out multiple ones of the recited bending operations simultaneously. It will be appreciated by those skilled in the art that although the preferred hanger 10 is fabricated from sheet metal by stamping operations, many other approaches can be employed to yield an equivalent structure. These include, inter alia, welding cantilevered wire arms (not shown) onto a suitable backing plate.

Figure 3:
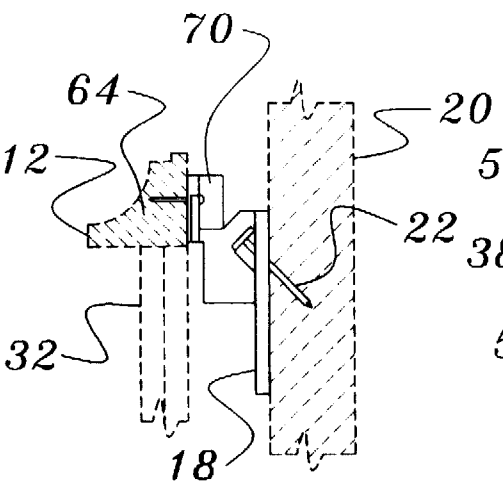
FIG. 3 is a right side elevational view of the device of FIG. 1 showing the nail-on hanger attached to a wall and supporting a wooden picture frame having a centered hanger bar nailed to an upper molding of the frame, the centered hanger bar resting on ledge portions of the hanger, the ledge portions adjacent respective vertically pointed free ends of the cantilevered arms.
Figure 2:
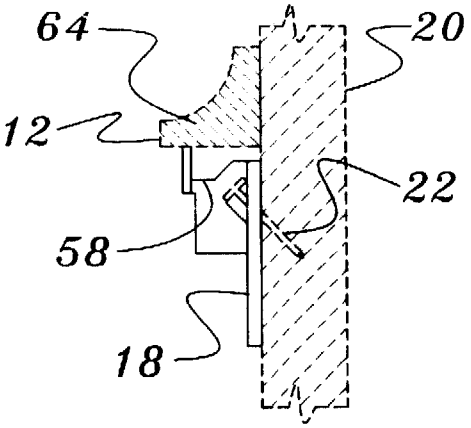
FIG. 2 is a right side view of the apparatus of FIG. 1 showing the nail-on hanger attached to a wall and supporting a wooden picture frame.
Figure 6:
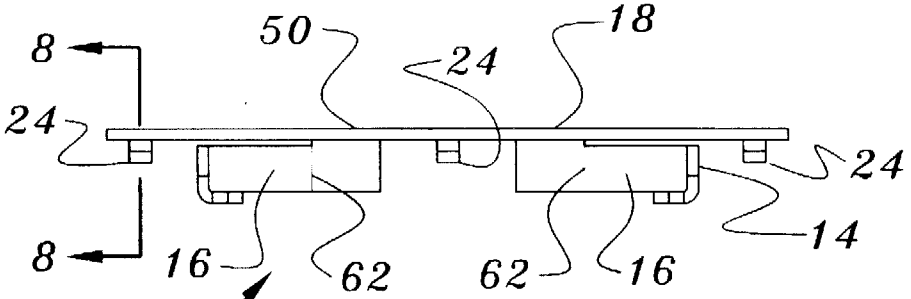
FIG. 6 is a top view of the device of FIG. 1.
Figure 5:
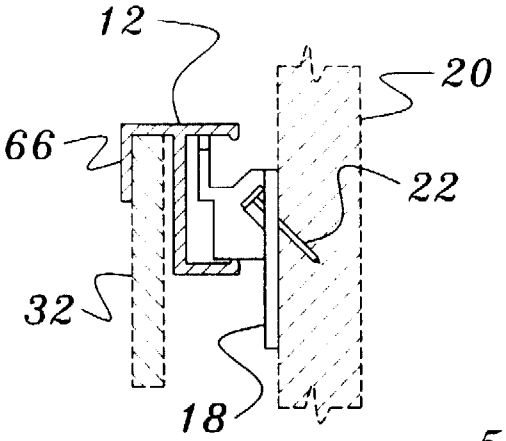
FIG. 5 is a right side elevational view of the device of FIG. 1 showing the nail-on hanger attached to a wall and supporting an extruded aluminum picture frame on the vertically pointed ends of the cantilevered arms.

To use the picture hanger 10 of the invention, one may nail it to a wall 20 at a desired height with the top 26 of the hanger 10 substantially horizontal. A picture, mirror, or the like that is mounted in a wooden frame 64 may be mounted on the pointed end portions 14 of that hanger 10, as depicted in FIGS. 1 and 2. The pointed end portions 14, which are parallel to the grain of the wooden frame 64, commonly penetrate a little ways into the wood, which aids in securing the picture. Pictures, mirrors and the like that are mounted in extruded aluminum frames 66 may likewise be supported on the pointed ends 14 of the cantilevered arms 15, as depicted in FIG. 5. Rolled sheet metal frames 68 (see FIG. 4), and wooden frames that have a nailed-on hanger bar 70 (see the depiction of FIG. 3), on the other hand, may be supported on the upper edges of the intermediate arm segments 58.

Regardless of which portion of the hanger contacts the picture, mirror or the like, if inspection subsequent to hanging indicates the picture is not truly level, one may then bend one of the cantilevered arms 16 downward by manually pushing down on one side of the frame 12. In a preferred embodiment of the hanger, this operation is facilitated by the provision of a score line 62 (which may comprise a single scoring or a plurality of indentations) at the base of the cantilevered arms 16. It will be understood to those skilled in the art that a wide variety of choices exist for the material from which the hanger is to be made (e.g., a specific selection of a metal alloy having a desirable temper), of its thickness, and of the geometry of the score lines 62, and that appropriate ones of these choices can be made to define a series of hangers 10 adapted to support pictures of various sizes and weights.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. Apparatus for hanging a picture frame or like object from a vertical supporting surface, the apparatus symmetrical about a mirror plane, the apparatus comprising a back plate having a top, a bottom, two sides, a front surface and a rear surface, the back plate adapted for attachment to the vertical supporting surface so that the rear surface of the plate is adjacent the vertical supporting surface;

two cantilevered arm portions, each cantilevered arm portion attached to the back plate on a respective side of the mirror plane, each of the cantilevered arm portions extending laterally outward from its respective attachment to the back plate;

two intermediate arm segments, each of the intermediate arm segments attached to a respective cantilevered arm segment adjacent that end of the cantilevered arm segment that is distal from the back plate, each intermediate arm segment substantially perpendicular to the back plate and disposed adjacent the front surface thereof; and two upstanding end portions, each of the upstanding end portions attached adjacent that end of a respective intermediate arm segment that is distal from the back plate.

2. The apparatus of claim 1 wherein the back plate further comprises a depending leg portion extending below the cantilevered arm segments.

3. The apparatus of claim 1 wherein the back plate comprises a plurality of shear-formed nailing guides cut therethrough, each of the nailing guides comprising a slot defining a cantilevered guide tongue, the guide tongue bent outward from the back plate.

4. The apparatus of claim 1 wherein the back plate, cantilevered arm segments, intermediate arm segments and upstanding end portions are integrally formed from a single sheet of material.

5. A method of forming a hanger for a picture frame or like object from a sheet of material, the method comprising the steps of:

a) cutting from the sheet a sheet portion symmetrical about a mirror plane perpendicular to the sheet, the sheet portion having a top, a bottom and two sides, the sheet portion further comprising a pair of bifurcating slits, each of the slits extending inwardly from a respective one of the sides toward the mirror plane, thereby defining an upper and an elongate lower leg on each of the two sides of the sheet portion;

b) folding the sheet portion along a first fold line perpendicular to the mirror plane, the first fold line extending along each of the bifurcating slits;

c) folding each of the lower legs along respective second fold lines, each of the second fold lines parallel to the mirror plane and equally spaced therefrom, each of the second fold lines distal from the end of the respective bifurcating slit, thereby forming first and second intermediate segments;

d) folding each of the intermediate segments along respective third fold lines parallel to and equally spaced from the mirror plane, thereby forming first and second upstanding end portions, each of the upstanding end portions parallel to the upper legs.

6. The method of claim 5 wherein steps a) through d) are carried out with a progressive die.

* * * * *